US007192126B2

(12) United States Patent
Hilton et al.

(10) Patent No.: US 7,192,126 B2
(45) Date of Patent: Mar. 20, 2007

(54) SYSTEMS, METHODS AND STRUCTURE FOR MAXIMIZING EFFICIENCY OF REFILLABLE FLUID EJECTION HEAD

(75) Inventors: Brian S. Hilton, Rochester, NY (US); Kazuyuki Oda, Toda (JP); Takatoshi Tsuchiya, Fujisawa (JP); Eric A. Merz, Palmyra, NY (US); Katsushi Amarume, Atsugi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 225 days.

(21) Appl. No.: 10/751,518

(22) Filed: Jan. 6, 2004

(65) Prior Publication Data

US 2005/0146571 A1 Jul. 7, 2005

(51) Int. Cl.
*B41J 2/175* (2006.01)

(52) U.S. Cl. ..... 347/85

(58) Field of Classification Search ..... 347/7, 347/85, 86, 87, 84

See application file for complete search history.

(56) References Cited

U.S. PATENT DOCUMENTS

| | | | | |
|---|---|---|---|---|
| 4,968,998 | A * | 11/1990 | Allen | 347/7 |
| 5,900,895 | A * | 5/1999 | Merrill | 347/86 |
| 6,022,102 | A * | 2/2000 | Ikkatai et al. | 347/85 |
| 6,234,615 | B1 * | 5/2001 | Tsukuda | 347/85 |
| 6,390,611 | B1 * | 5/2002 | Kobayashi et al. | 347/84 |
| 6,520,630 | B1 * | 2/2003 | Oda et al. | 347/85 |
| 6,866,372 | B2 * | 3/2005 | Oda et al. | 347/85 |
| 6,905,197 | B2 * | 6/2005 | Suenaga et al. | 347/85 |

* cited by examiner

*Primary Examiner*—Anh T. N. Vo
(74) *Attorney, Agent, or Firm*—Oliff & Berridge, PLC

(57) ABSTRACT

A refillable fluid reservoir for a fluid ejection head, including a fluid reservoir having top, bottom and side walls defining an interior volume for having fluid; a venting port provided on one of the reservoir walls; and a fluid inlet port provided on one of the reservoir walls, the venting port and the fluid inlet port being located at substantially the same vertical level to increase volumetric efficiency and reduce staining.

11 Claims, 5 Drawing Sheets

SYSTEMS, METHODS AND STRUCTURE FOR MAXIMIZING EFFICIENCY OF REFILLABLE FLUID EJECTION HEAD

BACKGROUND OF THE INVENTION

1. Field of Invention

This invention relates to controlling fluid quantity in a fluid ejection head.

2. Description of Related Art

Fluid ejector systems, such as drop-on-demand liquid ink printers, have at least one fluid ejector from which droplets of fluid are ejected towards a receiving sheet. For example, scanning inkjet printers are equipped with printheads containing fluid ink. The ink is applied to a sheet in an arrangement based on print data received from a computer, scanner or similar device. To control the delivery of the fluid to the sheet, fluid ejection heads are moved across the sheet to provide the fluid to the sheet, which is ejected as drops. Each drop corresponds to a liquid volume designated as a pixel. Each pixel is related to a quantity needed to darken or cover a particular unit area.

In order to lower cost and improve performance by limiting inertia, moving-head fluid ejection systems are designed with low-weight fluid ejection heads. In order to minimize weight, the fluid ejection heads contain a relatively small quantity of fluid. Consequently, the fluid ejection heads (or their fluid reservoirs) must either be periodically replaced or refilled. Refillable cartridges are commonly used in home-use printers. Some heavier-use printers in industry attach the fluid ejector via an umbilical tube to a larger tank for continuous refilling. Other heavier-use printers periodically refill the fluid ejection head.

SUMMARY OF THE INVENTION

Refilling cartridges requires frequent interaction by the user, and is considered disadvantageous for fluid ejectors used in volume production or connected by a network to the ejection data source. Umbilical systems can be expensive, requiring pressurization, tubing, tube harness dressing, and can suffer performance degradation from moisture loss, pressure fluctuations due to acceleration or temperature variation, and motion hysterisis from tubing harness drag.

In the related art, two vertically aligned refill ports are provided on the side of a fluid ejection head. The refill ports are provided at a refill junction in a configuration where a top port is a venting port and a bottom port is a fluid inlet port. The fluid is introduced through a needle or tubing from a refill station which engages the fluid inlet port. Fluid is either pushed into the bottom port under pressure or a vacuum is applied to the top port to draw the fluid in through the bottom port. The fluid is introduced through a needle or tubing which engages the port. Fluid fill volume in a fluid reservoir, however, is limited in such related art designs because when the fluid level reaches either inlet port, the fluid tends to leak when the refill station is disengaged from the port. Thus, whether fluid exceeds the level of the lower port, leakage or staining will occur.

Consequently, the fluid reservoir 110 in a fluid ejector 100 must be significantly underfilled in order to avoid excess fluid spilling out of the refilled fluid reservoir. This underfilling wastes available reservoir space and reduces the productivity of the fluid ejection device due to the greater frequency of refill operations.

Accordingly, containers for consumable fluids in various applications of fluid ejection may require a configuration that wastes space and reduces productivity. Such applications include, but are not limited to, ink-jet printers, fuel cells, dispensing medication, pharmaceuticals, photo results and the like onto a receiving medium, injecting reducing agents into engine exhaust to control emissions, draining condensation during refrigeration, etc.

This invention provides systems, methods and structures to utilize the maximum refill capacity of a fluid reservoir.

This invention separately provides systems, methods and structure to prevent the spilling of fluid during a fluid refill operation.

In various exemplary embodiments of the systems, methods and structures of the invention, a refill system for a fluid reservoir includes a venting port and a fluid inlet port. In various exemplary embodiments the venting port and the fluid inlet port are located at the same vertical level. This configuration allows the fluid reservoir to be volumetrically efficient while preventing the leakage of fluid from the fluid inlet port.

In various exemplary embodiments, a refill system for a fluid reservoir includes a venting port and a fluid inlet port. In various exemplary embodiments, the venting port is located below the inlet port. A tube is run from the vent port and opens at a level at or above the level of the fluid inlet port. This allows the design to maximize the height of the fluid inlet port, while minimizing ink stain.

In various exemplary embodiments, the venting port and the fluid inlet port are located at a top portion of the fluid ejection head. In various exemplary embodiments, the venting port and the fluid inlet port located at a top portion of the fluid ejection head have vertical inlet axes. In other various exemplary embodiments, the venting port and the fluid inlet port may have inlet axes which are at an angle relative to a vertical axis.

In various exemplary embodiments according to the systems, methods and structure of the invention, the fluid inlet port and vent port are sealed by a ball valve seal to prevent fluid from spilling. It should be appreciated that other seals could be used. For example, needle septum, poppet valve, flapper valve, O-ring, piston seal, etc.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the devices, systems and methods of this invention will be described in detail with reference to the following figures, wherein.

DETAILED DESCRIPTION OF EXEMPLARY EMBODIMENTS

The following detailed description of various exemplary embodiments of the fluid ejection systems according to this invention may refer to one specific type of fluid ejection system, e.g., an inkjet printer, for sake of clarity and familiarity. However, it should be appreciated that the principles of this invention, as outlined and/or discussed below, can be equally applied to any known or later-developed fluid ejection system, beyond the fluid jet printer specifically discussed herein.

A fluid ejector, such as, for example, an inkjet printhead, is produced, distributed and/or installed with a fluid reservoir, such as, for example, and an ink reservoir, typically filled with a fluid, such as, for example, ink. The fluid ejector, includes, in accordance with this invention, a portion referred to as a refill junction.

Figure 1:
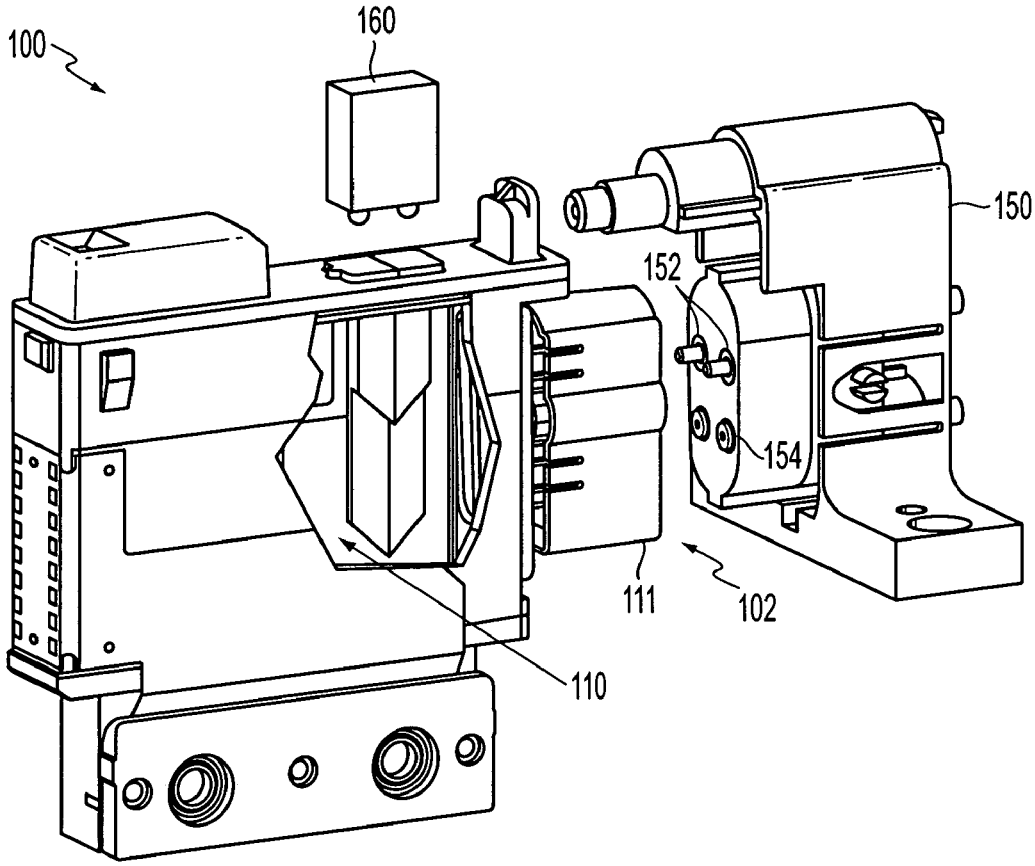
FIG. 1 is an isometric view of an exemplary embodiment of a fluid refill system.
Figure 2:
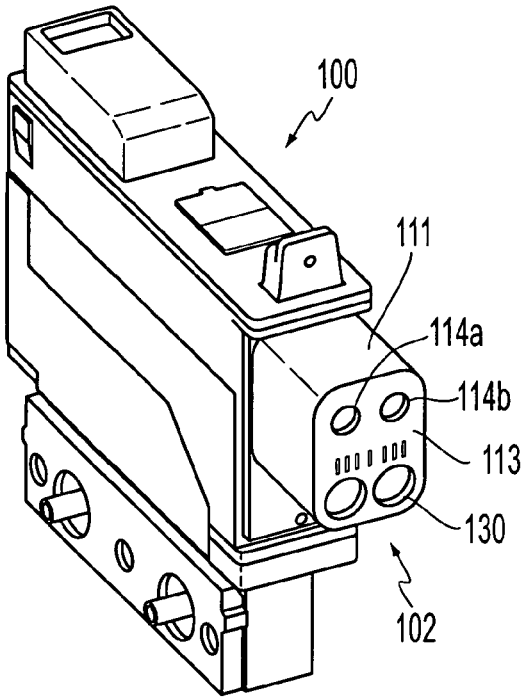
FIG. 2 is an isometric view of a fluid ejection head according to an exemplary embodiment of the invention.
Figure 3:
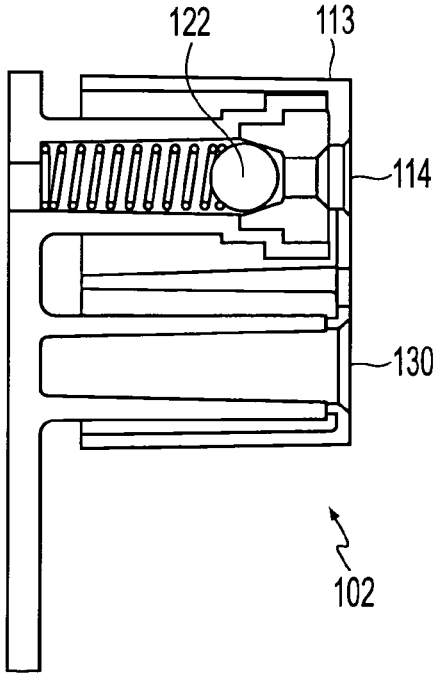
FIG. 3 is a cross-sectional view of a fluid refill junction according to an exemplary embodiment of the invention.

FIGS. 1–3 show a fluid ejection system according to this invention having a fluid ejection head 100 connectable with a fluid refill station 150. As shown in FIG. 1, the fluid ejection head 100 includes a refillable fluid container or reservoir 110 with a refill function 102. The fluid reservoir 110 of the fluid ejection head 100 can be connected to the refill station 150 when a detector 160 detects, for example, that the fluid level in the fluid reservoir 110 has fallen below a predetermined level. Subsequently, the fluid reservoir 110 of the fluid ejection head 100 can be disconnected from the refill station 150 when the detector detects that the level in the fluid reservoir 110 has risen to, for example, a position above the predetermined level.

As better shown in FIG. 2, fluid ejection head 100 has the refill junction 102 provided on a lateral side of the reservoir 110. Refill junction 102 includes refill ports 114*a* and 114*b* and alignment holes 130. In various exemplary embodiments, alignment holes 130 are used to align a retaining clip 111 when securing it to printhead 100 and/or to mate with corresponding alignment features 154 in the refill station 150.

In various exemplary embodiments, the retaining clip 111 serves to cover the refill junction 102 between the reservoir 110 and the refill station 150. FIG. 2 shows the front face 113 of the retaining clip. An air inlet port and an ink inlet port are collectively shown as refill ports 114. Each refill port 114 has a respective injection tube or needle 152 on refill station 150 and is aligned thereto.

When the reservoir 110 is low on fluid, the printhead 100 is transported to the refill station 150. The refill ports 114 are then positioned to be aligned with the refill station needles or tubing 152 of refill station 150 and are engaged thereto. To aid in alignment, alignment holes 130 may also align with alignment features 154.

In various exemplary embodiments, refill port 114*a* is a fluid inlet port and 114*b* is a venting port. It should be appreciated that either refill port 114*a* or 114*b* may be the fluid inlet port on the venting port so long as the needles or tubes 152 located at refill station 150 correctly correspond.

Each refill port 114 is provided with a valve which is normally closed to provide a seal. When the refill station needles or tubes engage the refill ports, the valves are opened. In various exemplary embodiments, one of the needles or tubes applies a pressure less than atmospheric, decreasing the pressure within the reservoir 110 and draining fluid from the second needle or tube that is connected to the fluid supply. In other exemplary embodiments, one of the needles or tubes is connected to a pressurized source of fluid which fills the reservoir 110 through one refill port while the second refill port is vented to atmospheric pressure.

During this process, fluid may pool on the outside surfaces of the printhead resulting in staining, poor print quality and user contamination.

In the exemplary embodiment shown in FIGS. 2–3, venting port 114*b* is located at substantially the same height as fluid inlet port 114*a*. Moreover, both the refill ports 114*a* and 114*b* are located at an upper portion of the fluid ejection head refill junction 102. This allows maximum use of the space of 110 reservoir, since it allows fluid to fill the reservoir 110 up to the height of fluid inlet port 114*a* before encountering staining.

As shown in FIG. 3, the inlet ports 114A, 114B may be provided with a ball valve seal connection 120. Ball valve seal 120 in exemplary embodiments includes a ball 122 biased by a spring 124 to be in contact with a seal 126. In one exemplary embodiment, the seal is a compliant seal. In other exemplary embodiments seal 126 may be a septum type seal.

When the reservoir 110 is to be refilled, the needle or tube engages the ball 122 to overcome the bias of the spring 124 and separates the ball 122 from the seal 126 to create a passage for fluid or air from the refill station to or from the reservoir 110. When the needle or tube is removed from refill port 114, the ball 122 is again biased by the spring 124 to come into contact with seal 126 to reduce or prevent fluid or air from escaping into or out of the reservoir 110.

Figure 4:
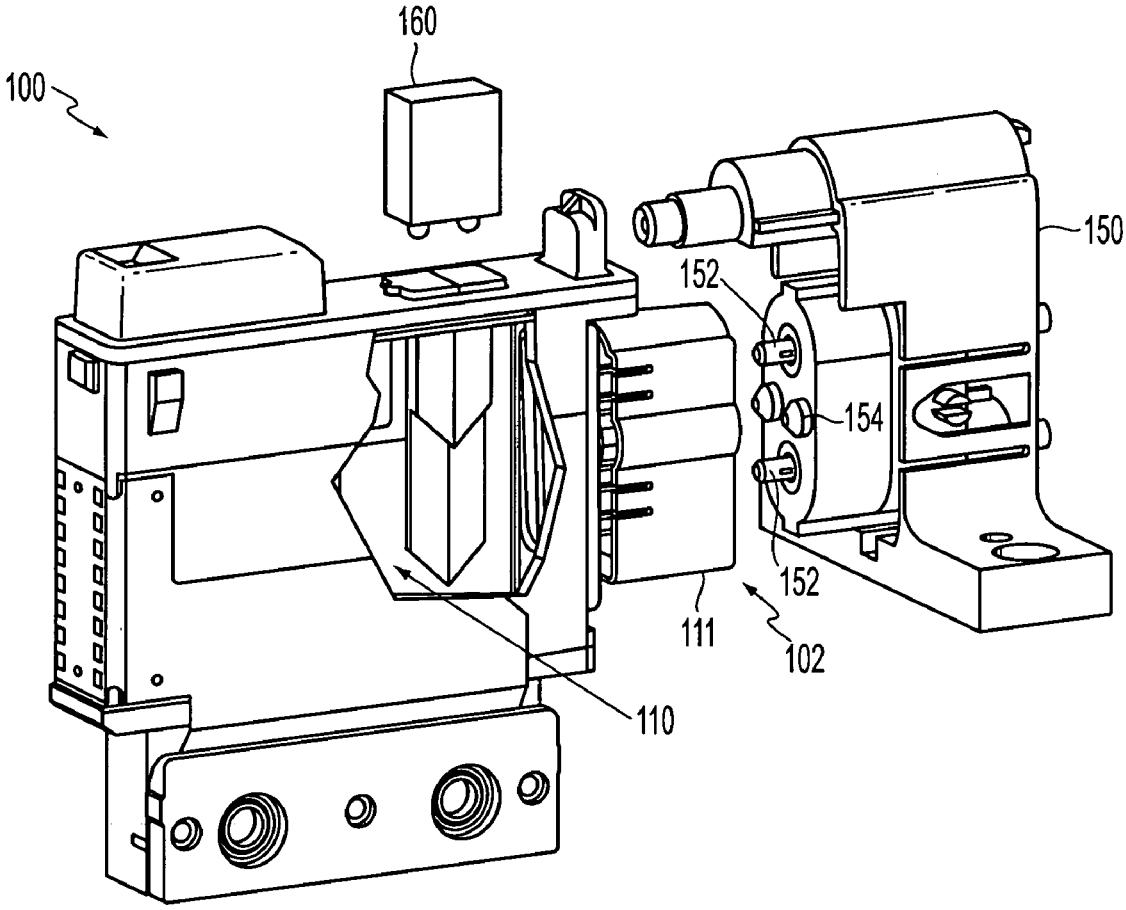
FIG. 4 is an isometric view of a second exemplary embodiment of a fluid refill system.
Figure 5:
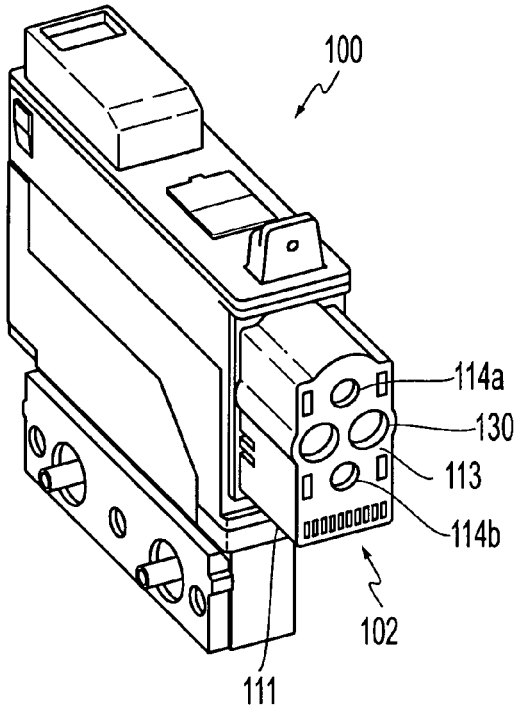
FIG. 5 is an isometric view of a fluid ejection head according to a second exemplary embodiment of the invention.
Figure 6:
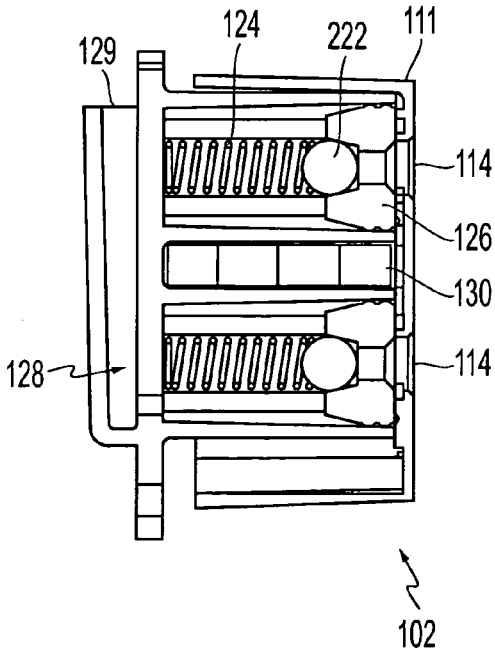
FIG. 6 is a cross-sectional view of a fluid refill junction according to a second embodiment of the invention.

FIGS. 4–6 show a second exemplary embodiment of the invention in which the refill ports 114*a*, 114*b* are vertically aligned.

As in FIG. 2, refill ports 114*a* and 114*b* in FIG. 5 are respectively a fluid inlet port and a venting port. According to an exemplary embodiment of the invention, fluid inlet port 114*a* is located on an upper portion of refill junction 102. Venting port 114*b* is located below fluid inlet port 114*a*. As better shown in FIG. 6, venting port 114B is provided with a tube 128 which opens to the atmosphere at a level at or above the level of the fluid inlet port 114*a*. By providing tube 128 with an opening 129 to the atmosphere at or above the level of fluid inlet port 114*a*, the reservoir 110 is able to be filled up to the level of fluid inlet port 114*a*, which in the exemplary embodiment is located at an upper portion of the refill junction 102, which in turn is located at an upper portion of the fluid ejection head 100. As such, even with a vertically aligned configuration, similar fluid capacity can be achieved as the prior embodiment without staining.

In addition, according to one exemplary embodiment of the systems, methods and structures of the invention, tube 128 may have a ball valve seal whose operation is synchronized with the operation of the valves provided in refill ports 114.

FIG. 6 shows a section view of a fluid refill junction and fluid refill ports 114 of FIG. 5. According to an exemplary embodiment of the invention, ball valve seal 120 is provided at the junction of refill station 150 and reservoir 110 as in the prior embodiment. The ball valve seal 120 includes a ball 122 biased by spring 124 to be in contact with seal 126. In one exemplary embodiment, seal 126 is a compliant seal. In other exemplary embodiments, seal 126 can be a septum type seal which is pierced by a needle or has a hole in it to receive a needle or tube from refill station 130 or a combination of a septum type seal with a hole.

Figure 7:
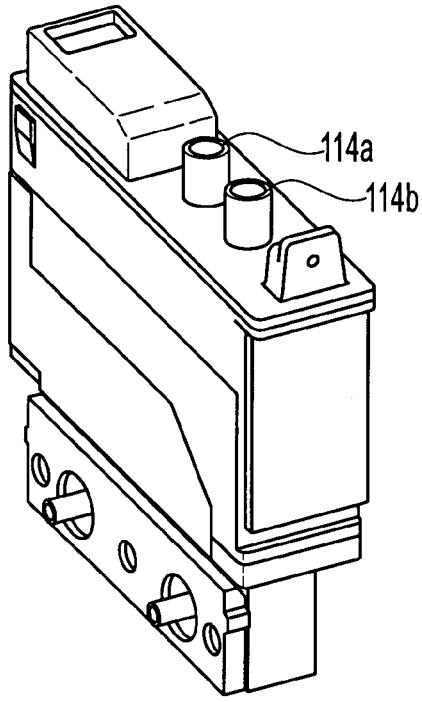
FIG. 7 is a isometric view of a fluid ejection head according to an exemplary embodiment of the invention.
Figure 8:
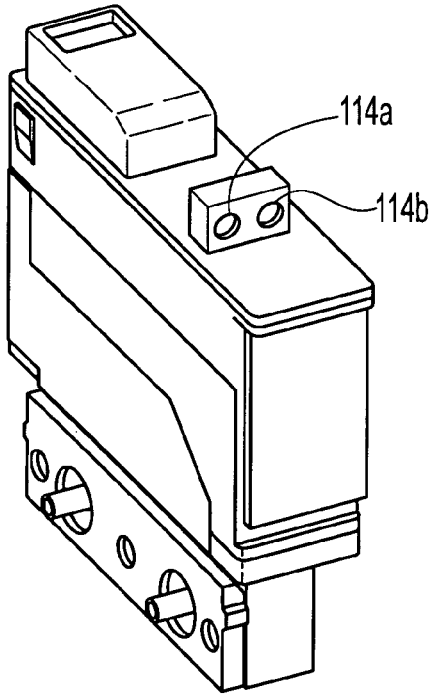
FIG. 8 is an isometric view of a fluid ejection head according to an exemplary embodiment of the invention.

As shown in FIG. 7, according to an exemplary embodiment of the systems, methods and structure of the invention the refill ports 114*a, b* may be located at a top portion of the fluid ejection head 100. The inlet axes of the refill ports 114 may be aligned vertically. In various exemplary embodiments, the inlet axes may be aligned at any suitable angle relative to a vertical axis, as shown in FIG. 8. It should be appreciated that refill station 150 needles and tubing must be provided and aligned to match the angle of the inlet axes. These embodiments allow additional fluid capacity for volumetric efficiency, at the possible expense of increased fluid ejector head height.

While this invention has been described in conjunction with exemplary embodiments outline above, many alternatives, modifications and variations will be apparent to those skilled in the art. Accordingly, the exemplary embodiments of the invention, as set forth above, are intended to be illustrative, not limiting. Various changes can be made without departing from the spirit and scope of the invention.

What is claimed is:

1. A refillable fluid reservoir for a fluid ejection head, comprising:

a fluid reservoir having top, bottom and side walls defining an interior volume for housing fluid;

a venting port provided on one of the reservoir walls, the venting port having an open end; and a fluid inlet port provided on the one of the reservoir walls, the fluid inlet port having an open end, wherein:

the venting port and the fluid inlet port are located in a side wall of the fluid reservoir; and the open end of the venting port and the open end of the fluid inlet port being located at substantially a same level, in a gravitational direction, to increase volumetric efficiency and reduce staining.

2. The fluid reservoir according to claim 1, at least one of the venting port and the fluid inlet port having a seal.

3. The fluid reservoir according to claim 2, the seal being selected from a group consisting of ball valve seals, needle septum, poppet valves, flapper valves, O-rings and piston seals.

4. An inkjet printhead comprising:

the refillable fluid reservoir according to claim 1.

5. A refillable fluid reservoir for a fluid ejection head, comprising:

a fluid reservoir having top, bottom and side walls defining an interior volume for housing fluid;

a venting port provided on one side wall of the reservoir, the venting port having an open end;

a fluid inlet port provided on the one side wall of the reservoir, the fluid inlet port having an open end, the open end of the fluid inlet port being located at a higher level, in a gravitational direction, than the open end of the venting port; and a tube formed from the open end of the venting port and having an opening to the atmosphere at a level, in the gravitational direction, at least equal to a level, in the gravitational direction, of the open end of the fluid inlet port, to increase volumetric efficiency and reduce staining.

6. The fluid reservoir according to claim 5, at least one of the venting port, the fluid inlet port and the tube having a seal.

7. The fluid reservoir according to claim 6, the seal being selected from a group consisting of ball valve seals, needle septums, poppet valves, flapper valves, O-rings, and piston seals.

8. An inkjet printhead, comprising:

the fluid reservoir according to claim 5.

9. The fluid reservoir according to claim 5, the fluid inlet port being located near a top portion of the reservoir.

10. The fluid reservoir according to claim 5, the venting port and the fluid inlet port having substantially horizontal inlet axes.

11. The fluid reservoir according to claim 5, the venting port and the fluid inlet port having inlet axes aligned at an angle with respect to a vertical axis.

* * * * *